US005570275A

United States Patent [19]

Luquire

[11] Patent Number: 5,570,275

[45] Date of Patent: Oct. 29, 1996

[54] SPORTS CARD VIEWING APPARATUS

[76] Inventor: Leo H. Luquire, 1742 Radcliffe Rd., Montgomery, Ala. 36106

[21] Appl. No.: 399,435

[22] Filed: Mar. 7, 1995

[51] Int. Cl.[6] ..... F21V 33/00

[52] U.S. Cl. ..... 362/125; 362/31; 362/253; 362/99; 362/154; 40/546

[58] Field of Search ..... 362/125, 253, 362/99, 154, 268, 331, 375, 31, 26, 28, 29, 200; 40/152.2, 156, 124.1, 546

[56] References Cited

U.S. PATENT DOCUMENTS

| | | | |
|---|---|---|---|
| 4,236,192 | 11/1980 | Duggan | 362/125 X |
| 4,942,685 | 7/1990 | Lin | 40/152.2 |
| 5,041,954 | 8/1991 | Forrest, Jr. | 362/125 X |
| 5,111,366 | 5/1992 | Rife et al. | 362/31 |
| 5,180,222 | 1/1993 | Robinson | 362/125 |
| 5,247,745 | 9/1993 | Valentino | 40/546 X |
| 5,371,656 | 12/1994 | Iorfida | 302/31 |

*Primary Examiner*—Denise L. Gromada
*Assistant Examiner*—Thomas M. Sember
*Attorney, Agent, or Firm*—Mark Clodfelter

[57] ABSTRACT

A device for illuminating and magnifying printed cards for viewing is disclosed. A body of the device has a hollow central region with hollow, opposed sides. At least one pair of slots near a floor of the hollow central region receives at least one printed card, with a magnifying lens mounted in an upper region of the hollow central region. A separate enclosure having an illumination bulb mounted therein is provided in one of the hollow sides, with batteries mounted in another hollow side. An opening in the enclosure passes light across the central region, providing indirect illumination of the card.

28 Claims, 3 Drawing Sheets

SPORTS CARD VIEWING APPARATUS

FIELD OF THE INVENTION

This invention relates to illuminating viewing devices, and particularly to apparatus adapted to conveniently receive a plurality of documentary sports cards, such as baseball cards, in an enclosure where the cards are illuminated and magnified for viewing.

BACKGROUND OF THE INVENTION

Collectible documentary sports cards enjoy considerable popularity, and are collected by both adults and children. These cards are constructed of relatively stiff paper, plastic, or combinations thereof, and are available in a standardized size of 3.5 inches by 2.5 inches. Typically, a glossy or semi-glossy picture of an athlete is printed on one side of the card in either a landscape or portrait orientation, and documentary information and statistics about the athlete is printed on the other side.

As these cards are rather small, the pictures and documentary information thereon may sometimes be difficult to visualize and read. Additionally, the visual impact of a picture, particularly a picture depicting an athlete in action, is reduced due to the diminutive size of the card. Also, as some of these cards are quite rare, and thus valuable to collectors, determination of condition of these rare cards is important, and generally requires close scrutiny with a magnifying glass.

While Applicant is unaware of any particular device for viewing sports cards, devices of prior art which are believed to be most pertinent to the instant invention include patent references U.S. Pat. No. 5,041,954 to Forrest, filed Aug. 20, 1991, 4,236,192 to Duggan, filed Nov. 25, 1980, and 2,000,537 to Ransom, filed Aug. 15, 1932.

With respect to the reference of Forrest, an identification card inspection device is disclosed for examining identification cards, such as a driving license. This device consists of an enclosure, with a pair of transparent glass plates positioned at one end of the enclosure. These glass plates are oriented in spaced relation so as to form slot for receiving a single identification card therebetween. A transparent window, which may include a magnifying lens, is positioned in an opposite end of the enclosure, the window being angularly positioned with respect to a plane of the slot between the plates so as to reduce glare from the transparent plates and identification card. Illumination lights are mounted in the enclosure in front of and to each side of the transparent plates for directly illuminating the identification card. A lip is positioned between each of the lights and the window for blocking direct light from the bulb from impinging upon eyes of the viewer.

Problems inherent with the device of Forrest are that the illuminating lights, being in the enclosure in front of the identification card and plates, create glare on the transparent plates and the identification card. In an effort to reduce this glare, the plates that hold the card and the viewing window are angularly displaced with respect to each other. Where the viewing window includes a magnification lens, this angular displacement causes optical distortion of the viewed image. Additionally, there is no teaching or suggestion that the slot for receiving the identification card is sized so that more than one card may be placed in the device. Further, since the length and breadth of the slot is sized to receive identification cards of various sizes, cards not closely sized to the slot are likely to shift therein, which may necessitate re-positioning the card within the slot. Further yet, there is no teaching in Forrest of powering the lights thereof from a self-contained source of electrical power.

The reference of Duggan teaches a cabinet assembly for receiving a specimen for examination. The cabinet portion is constructed having a hood, with a lower rectilinear skirt, and an upper portion constructed in the shape of a truncated pyramid. A camera mount is provided in the truncated region of the upper portion for mounting a camera to the cabinet in order to record an image of the specimen. Illumination bulbs for providing light of a variety of wavelengths are mounted to interior sloping sides of the upper pyramidal region of the hood, directing light downward to illuminate the specimen from above. Additionally, a backlight source of illumination may be mounted to the bottom of the cabinet for illuminating the specimen from below.

The device of Duggan is a rather large device adapted for photographic inspection of a variety of objects, with no teaching of any means to hold an object to be examined in any particular orientation. Also, and as with the device of Forrest, light is directed onto the object to be examined from a point above the object, causing glare. Further, there is no teaching in Duggan of using a self-contained electrical source to power the illumination lights.

Ransom teaches a cabinet for receiving a sheet of printed material on a lower surface thereof for examination to determine uniformity of the print. A plurality of illumination bulbs are mounted at locations above the print, which bulbs being shielded from eyes of the user by shelves mounted to the interior of the cabinet.

As with the cabinet of Duggan, the cabinet of Ransom is a large cabinet adapted to receive a sheet of paper the size of newsprint. Additionally, the illumination bulbs are mounted above the printed material to be examined, again causing glare from the sheet of paper. Further, there is no teaching of powering the lights from a self-contained electrical source.

Accordingly, it is an object of the invention to provide a hand-held viewing apparatus to enhance the enjoyment of viewing cards such as sports cards, the apparatus also allowing close scrutiny of the cards. To this end, the viewing apparatus is adapted to receive a plurality of the cards both in landscape and portrait orientations, with the upper card being illuminated and accurately magnified in order to facilitate viewing thereof.

DETAILED DESCRIPTION OF THE DRAWINGS

Figure 2:
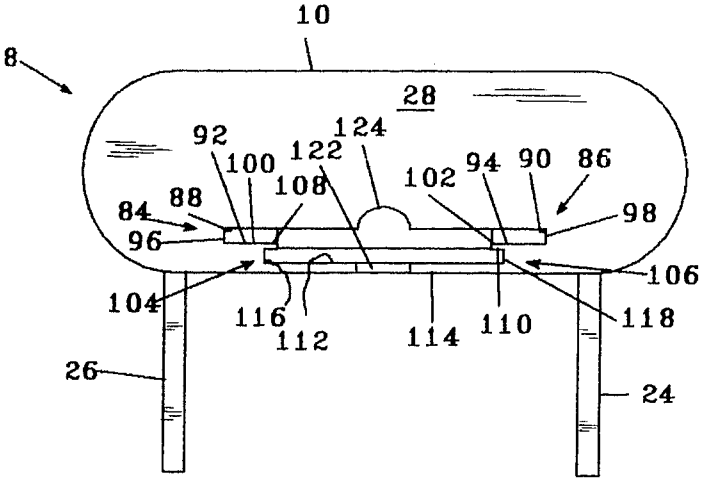
FIG. 2 is a view taken from an end of the instant invention wherein sports cards are inserted.
Figure 3:
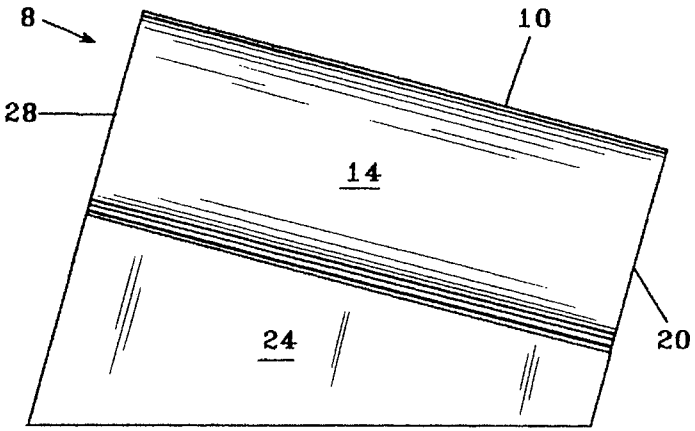
FIG. 3 is a side view of the instant invention.
Figure 1:
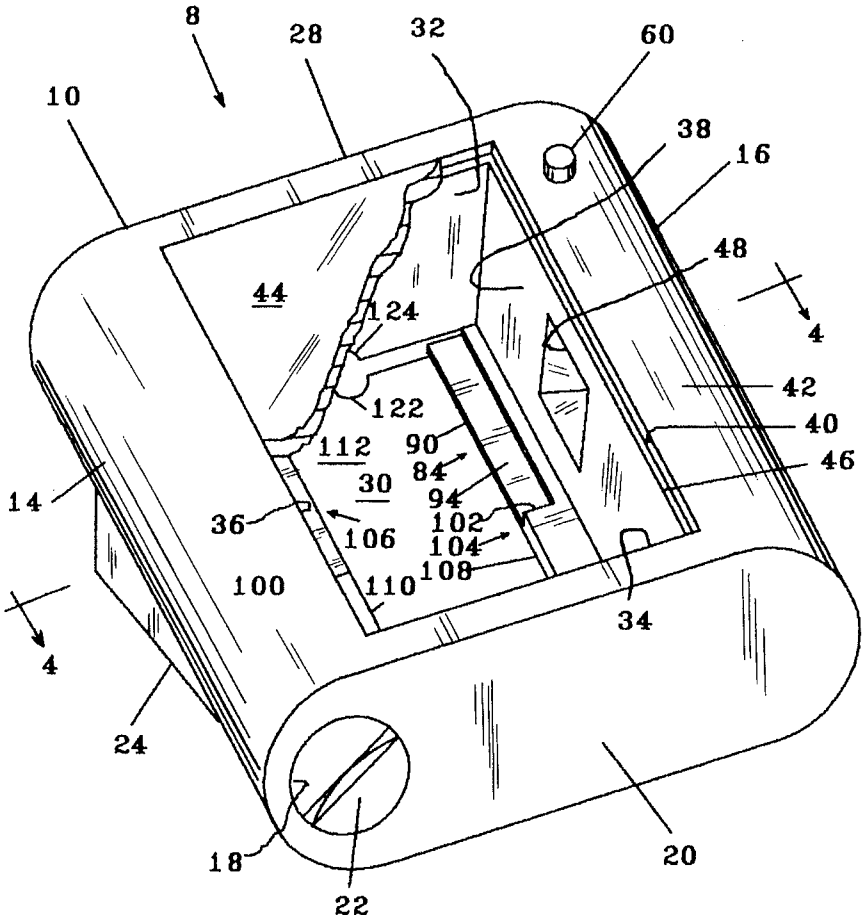
FIG. 1 is a perspective view taken from a point above and to one side of the instant invention, with a portion of a front lens thereof shown partially broken away.

Referring initially to FIGS. 1–3, one embodiment of a sports card viewer 8 of the instant invention is shown. Here, a body 10 supports and contains components of the viewer, and is constructed having sides 14 and 16 of rounded, elongated contour. Sides 14 and 16 provide grips for left and right hands, respectively, so that viewer 8 may be conveniently held by the user. A threaded opening 18 in base 20 is closed by a threaded plug 22 so that batteries may be removed and replaced, as will be described. Where the viewer is used on a flat surface, such as a table, angled supports 24 and 26 orient viewer 8 generally normal to a line of sight from the viewer's eyes. Additionally, supports 24 and 26 elevate upper region 28 of the viewer, facilitating insertion and removal of the sports cards.

Viewer 8 is provided with a generally hollow central region 30 (FIG. 1) defined by inner upper and lower walls 32 and 34, respectively, and inner left and right walls 36 and 38, respectively. These walls are provided with a generally reflective, light scattering coating, such as a flat white paint or the like, that diffuses and scatters light evenly throughout the interior of region 30. If desired, surfaces of these walls may be provided with an irregular, textured surface, for enhancing light scattering properties of the coating. An opening 40 in an upper surface 42 of viewer 8 communicates with central region 30, with opening 40 having a magnifying lens 44 (shown partially cut away) mounted therein. Lens 44 may be mounted in opening 40 as by means of a lip 46 to which lens 44 may be bonded or otherwise attached, in order to magnify the image and printed material on the sports card.

In the embodiment shown, an opening 48 is provided in inner wall 38, which opening 48 communicating with an enclosure 50 (FIG. 4) which is separate and distinct from region 30. Enclosure 50 is housed inside contoured side 16 of body 10, and supports a mounting fixture 52 for an illumination bulb 54. Interior walls of enclosure 50 are preferably configured having light scattering interior surfaces as described above, for scattering light into central hollow region 30. Significantly, enclosure 50 is sized and configured such that bulb 54 is completely housed within enclosure 50, permitting no direct illumination of a card in viewer 8 by light from bulb 54. As such, the card is indirectly illuminated by light from bulb 54, which eliminates glare from the glossy or semi-glossy surface of the sports card which otherwise would result from direct illumination by bulb 54. Additionally, such an enclosed mounting for the bulb shields the viewer from a direct view of the bulb, eliminating the need to provide a ledge or shelf for this purpose within region 30, which could block a portion of a view of the card. With this indirect type of illumination, in combination with a magnifying lens and the light scattering character of the interior of the enclosure and central region 30, the image of the sports card is greatly enhanced, adding to the enjoyment of viewing sports cards.

Mounting fixture 52 is conventionally provided with terminals 56 and 58 for contacting terminal regions (not shown) of bulb 54. Bulb 54 in turn is selectively energized a conventional pushbutton switch 60 (schematically illustrated), which may be mounted as shown to housing 10 (FIG. 1). Switch 60 is provided with a pair of terminals 62 and 64 (FIG. 4), with one of these terminals (62) coupled via a conductor 66 to the positive terminal 68 of a battery carrier 70. Carrier 70 would typically carry a pair of batteries, shown oriented in series relation, and be housed in contoured side 14 of body 10. Terminal 64 of switch 60 is conventionally coupled Go one terminal (56) of mount 52, with the other terminal (58) of mount 52 coupled to negative terminal 72 of battery carrier 70 via a conductor 74. In this instance, conductors 66 and 74 would be of a length such that carrier 70 could be withdrawn from side 14 through opening 18. Alternately, carrier 70 may be constructed in the form of a cartridge provided with terminals that contact a matching set of terminals mounted in contoured side 14, the carrier being removable in order to change the batteries. Another battery mounting arrangement that may be employed is one wherein carrier 70 is permanently mounted in side 14, and accessible via a removable panel (not shown) in an upper, side, or bottom region of side region 14. Yet another mounting arrangement that may be employed is one typically found in flashlights where the batteries are held in a tubular region and spring loaded so as to urge the batteries into electrical contact with each other and with electrical terminals at each end of the tubular region.

While a battery carrier for carrying the batteries is disclosed, it is to be appreciated that the batteries may be mounted in any other arrangement as would be convenient for manufacture. Additionally, conductors 66 and 74 may be routed in any manner as convenient for manufacturing and aesthetic considerations, as by molding a channel in the interior side of wall 34 for receiving conductors 66 and 74.

In order to disperse light from bulb 54 evenly throughout the interior of region 30, surfaces 78 of enclosure 50 are conformed so as to generally reflect and scatter light from bulb 54 across region 30 and against the opposite wall 36. As stated, these surfaces 78 may be provided with the light-scattering coating so that light is further scattered upon being directed across region 30 from enclosure 50. As such, light is scattered in region 30 to provide indirect, bright, yet diffused, illumination of the sports card, eliminating glare that otherwise would result from any direct illumination of the card. This illumination arrangement allows lens 44 (FIG. 1) to be mounted in the same plane as the sports card, enabling optically accurate magnification thereof, while eliminating the necessity to mount the lens and card in angularly displaced relation in order to reduce glare.

While enclosure 50 (FIG. 4) is particularly disclosed as being mounted in side 16, enclosure 50 could alternately be located in base 20 of the viewer. In this embodiment, base 20 would be constructed having an inner wall and an outer wall, these inner and outer walls being spaced apart in order to mount enclosure 50 therebetween. An opening such as opening 48 would be centrally located in the inner wall to permit light from the bulb to pass into region 30. Battery carrier 54 could then be mounted in either of sides 14, 16, or space permitting, in base 20 along with enclosure 50.

Figure 4:
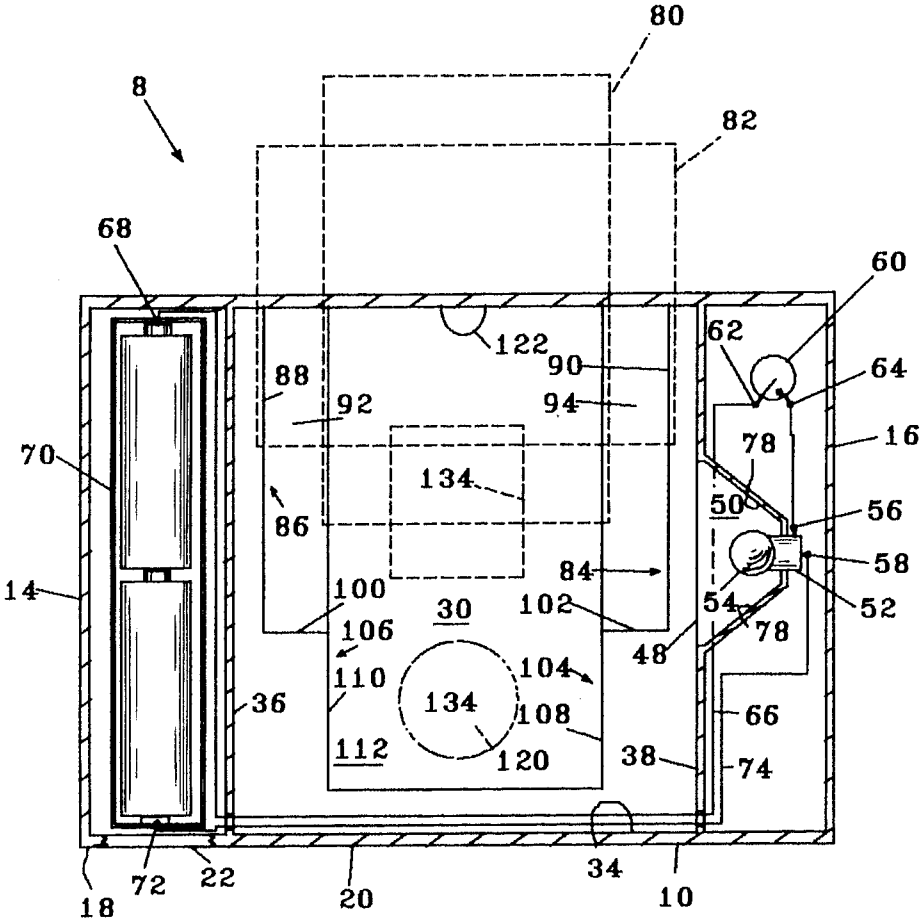
FIG. 4 is a sectional view taken along lines 4—4 of FIG. 1.

As it is generally inconvenient to insert and remove a single card at a time in/from viewer 8, means are provided so that a plurality of sports cards may be loaded into viewer 8 in both vertical and horizontal relation simultaneously, as shown in FIG. 4 by dashed line representations of partially inserted vertical and horizontal cards 80 and 82, respectively. Here, and referring additionally to FIGS. 1 and 2, a first pair of slots or grooves 84, 86 are defined by upper lips 88, 90, and raised, narrow floors 92, 94. Lips 88, 90 and floors 92, 94, respectively, are in opposed, spaced relation with respect to each other, with spacing between the lips and floors being such that a selected number of cards, such as the number of cards in a commercially available packet of cards, may be inserted into slots 84, 86. Spacing between slots 84, 86 is defined by outer walls 96, 98 (FIG. 2), and is such as to closely accommodate the lengthwise dimension of cards 82 having a landscape view printed thereacross. Ridges 100, 102 positioned on floors 92, 94 provide an abutment against which cards having a landscape view rest, limiting their travel within region 30, which would otherwise cause difficulty in their removal.

For cards 80 having a portrait view printed across the width thereof, a second pair of slots or grooves 104, 106 are provided, these slots defined by lips 108, 110 and floor 112, floor 112 also forming a back wall 114 of viewer 8. As with slots 84, 86, spacing between lips 108, 110 and floor 112 is such as to accommodate the number of sports cards found in a commercially available packet thereof. The distance between slots 104, 106 is defined by outer walls 116, 118, and is such as to closely accommodate the width dimension of cards 80 having a portrait view printed thereon. A second ridge 120 (FIG. 4) may be provided as an abutment for cards inserted between slots 104, 106, or the cards may abut directly against an inner surface of wall 34. Notches 122, 124 are provided in floor 112 and wall 32, respectively, to provide clearance for fingers of the user, whose fingers are inserted in notches 122, 124 to remove a top card adjacent lens 44, exposing the card beneath for viewing.

While viewer 8 is disclosed as having a lower wall 114, it is to be noted that most of this wall may be omitted, or constructed so that it is removable, leaving opposed slots 104, 106 so that a packet of cards may be placed lengthwise between these slots. This embodiment would be useful where it is desired to place other articles, such as postage stamps or coins beneath body 10 and between supports 24 and 26 for perusal of a magnified, illuminated image thereof. In this application, supports 24, 26 may be constructed having a rectangular configuration, or be adjustable, so that lens 44 of viewer 8 is in a like plane as a surface upon which the viewer rests. Alternately, supports 24, 26 may be omitted or constructed so that they are foldable or removable, allowing the user to hold an object in one hand for perusal with viewer 8, which could be held in the other hand. Additionally, this embodiment would allow cleaning of the inside surface of the lens, which otherwise would be completely enclosed within region 30. Further yet, by leaving the lower region substantially open as described, removal of the cards would be greatly facilitated.

Figure 5:
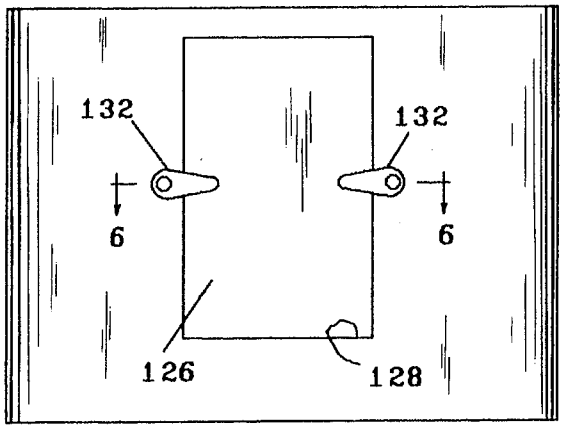
FIG. 5 is a view of a back region of the instant invention.
Figure 6:
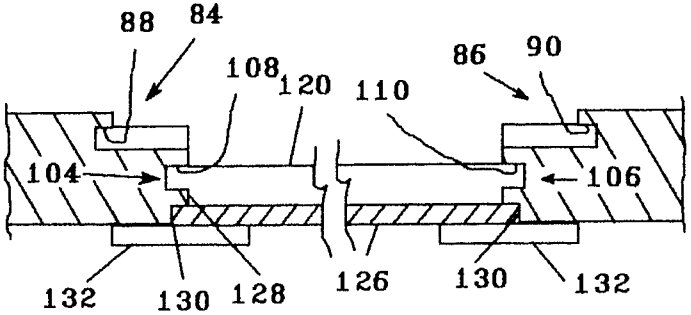
FIG. 6 is a sectional view taken along lines 6—6 of FIG. 5.

FIGS. 5 and 6 disclose an embodiment of the viewer as described above which is provided with a removable back. Here, by way of example, the back wall may be configured having a removable panel back 126, which panel 126 approximately sized to the dimensions of lips 108, 110, and ridge 120 (FIG. 4). With panel 126 removed, an opening 128 is exposed in the back of viewer 8, this opening being slightly smaller than a card inserted therein in lengthwise orientation. In this embodiment, edges of panel 126 (FIG. 6) may be fitted into grooves or recesses 130 adjacent opening 128, with panel 126 held in place by rotatable latches 132. If desired, recesses 134 (dashed lines in FIG. 4) may be molded in the inner side of panel 126 for placing coins and stamps therein for examination.

While a particular design for a removable back portion is disclosed, other designs for a removable back may be utilized, such as one where the back panel and bordering area is provided with mating dovetail type sides, or flexible snaps and mating catches.

Figure 7:
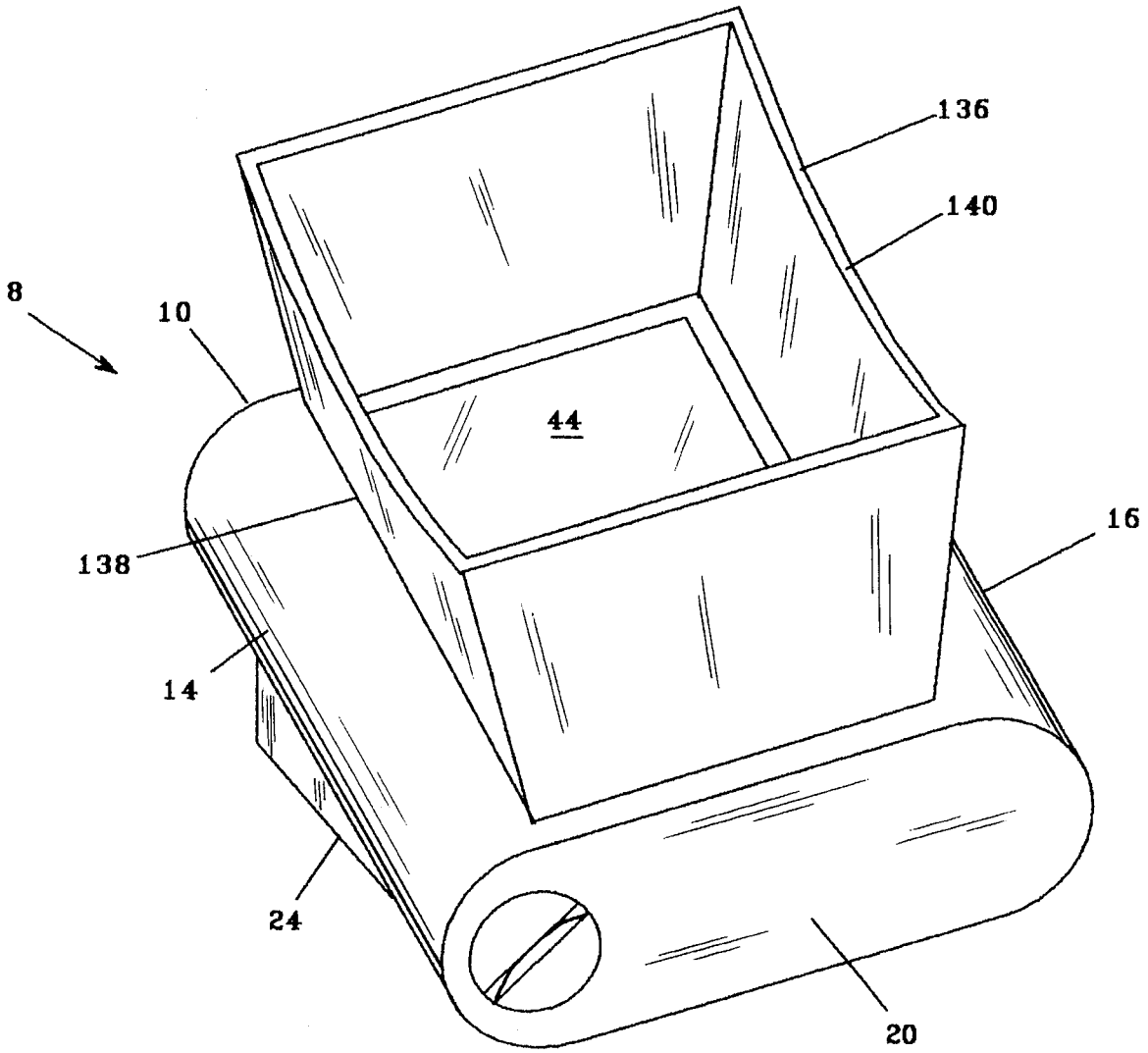
FIG. 7 is a perspective view of an alternate embodiment of the invention.

FIG. 7 illustrates a removable viewing hood 136 attached to viewer 8, as by hook and loop tape, or by catches constructed on lower edges 138 of hood 136 that engage openings in viewer 8 (not shown). Hood 136 would be used in high illumination conditions, such as outdoors, where hood 136 shields lens 44 from extraneous external light. If desired, upper edges 140 of hood 136 may be configured so as to fit the face of a user in a similar manner as a diver's mask, facilitating viewing of the cards by virtually eliminating external light.

Having thus described my invention and the manner of its use, it is apparent that incidental changes may be made thereto that fairly fall within the scope of the following appended claims, wherein I claim:

1. A viewing apparatus comprising:

a body having a hollow central region with a floor therein, and first and second hollow sides, a discrete enclosure in one of said first and second hollow sides, said enclosure having an opening communicating with said hollow central region, an illumination bulb mounted in said enclosure, an electrical power source in another one of said first and second hollow sides, and coupled to said bulb for selective energization thereof, a first pair of opposed slots defining a first plane adjacent said floor, said opposed slots spaced to receive at east one printed card therebetween, a magnifying lens mounted in said body over said floor, for magnifying said card, whereby said card is indirectly illuminated by light from said bulb and an illuminated image thereof magnified by said lens.

2. A viewing apparatus as set forth in claim 1 wherein said first and second hollow sides each has a common wall with said hollow central region.

3. A viewing apparatus as set forth in claim 1 wherein said first and second hollow sides are opposed from each other, with said hollow central region therebetween.

4. A viewing apparatus as set forth in claim 1 wherein sides of said enclosure are configured to generally direct light from said illumination bulb across said hollow central region.

5. A viewing apparatus as set forth in claim 1 wherein at least a portion of said floor is removable.

6. A viewing apparatus as set forth in claim 1 further comprising supports extending from said body, said supports configured to support said body in angular relation with respect to a surface upon which said viewing apparatus rests.

7. A viewing apparatus comprising:

a body having a hollow central region having a floor, and discrete, opposed first and second hollow sides configured to be held by a user, said hollow central region and each of said first and second sides having at least one common wall therebetween, an illumination bulb mounted in said first hollow side, with an opening in said common wall for allowing light from said bulb to pass across said central hollow region, an electrical power source in said second hollow side, and coupled to said bulb for selective energization thereof, a first pair of slots in said hollow central region defining a first plane not directly illuminated by said illumination bulb for receiving a plurality of sports cards in a portrait orientation, said first pair of slots being adjacent said floor, a second pair of slots in said hollow central region and defining a second plane not directly illuminated by said illumination bulb for receiving a plurality of said sports cards in a landscape orientation, said second pair of slots being adjacent to said first pair of slots, a magnifying lens mounted in an upper region of said body and over said hollow central region, for presenting a user with an illuminated and magnified image.

8. A viewing apparatus as set forth in claim 7 wherein said illumination bulb is housed in a separate enclosure, with sides of said enclosure configured to direct light from said bulb across said hollow central region.

9. A viewing apparatus as set forth in claim 7 wherein at least a portion of said lower floor is removable.

10. A viewing apparatus as set forth in claim 9 wherein said floor is configured to receive articles for indirect illumination and amplification.

11. A viewing apparatus as set forth in claim 7 wherein sides of said central hollow region are conformed to scatter light therethroughout.

12. A viewing apparatus set forth in claim 11 wherein said sides of said enclosure scatter light across said hollow central region.

13. A viewing apparatus set forth in claim 7 wherein said lens is mounted in a like plane as said plane defined by said first and second slots.

14. A viewing apparatus set forth in claim 7 further comprising a hood surrounding said lens, for blocking extraneous light therefrom.

15. A viewing apparatus for illuminating and viewing sports cards comprising:

a body having a hollow central region, with a floor across a lower region thereof, with at least a portion of said floor being removable, discrete, opposed first and second hollow sides configured to be held by a user, said hollow central region and each of said first and second sides having at least one common wall therebetween, an enclosure in one of said first and second hollow sides, said enclosure having as one side said common wall, and an opening in said common wall allowing communication between said hollow central region and said enclosure, an illumination bulb mounted in said enclosure, at least one battery mounted in another one of said first and second hollow sides, said battery coupled to said illumination bulb for selective energization thereof, a first pair of slots in said hollow central region, said first pair of slots defining a first plane not directly illuminated by said bulb for receiving a plurality of said sports cards in a portrait orientation, said first pair of slots being adjacent said floor, a second pair of slots in said hollow central region and defining a second plane not directly illuminated by said bulb for receiving a plurality of said sports cards in a landscape orientation, said second pair of slots being adjacent said first pair of slots, a magnifying lens mounted in an upper region of said body and over said central region, said lens mounted in a like plane as said floor of said hollow central region, for presenting a user with an illuminated and accurately magnified image of an upper sports card in said first and second pairs of slots.

16. A viewing apparatus as set forth in claim 15 wherein sides of said hollow central region and sides of said enclosure are configured to scatter light within said hollow central region.

17. A viewing apparatus comprising:

a body having a hollow central region, with one side configured for viewing thereinto, said body further provided with a first hollow side adjacent said side configured for viewing, a discrete enclosure in said hollow side, said enclosure having an opening communicating with said hollow central region, an illumination bulb mounted in said enclosure, a power source coupled to said bulb for selective energization thereof, at least one first pair of opposed slots positioned to receive a card along a side of said hollow central region opposed from said side configured for viewing, so that said card is indirectly illuminated by light from said bulb and viewable through said side configured for viewing.

18. A viewing apparatus as set forth in claim 17 wherein said body is provided with a second hollow side adjacent said hollow central region.

19. A viewing apparatus as set forth in claim 18 wherein said power source is mounted in another one of said first and second hollow sides.

20. A viewing apparatus as set forth in claim 17 further comprising a floor in said central hollow region, said floor positioned to a rear of said first pair of opposed slots.

21. A viewing apparatus as set forth in claim 17 further comprising a magnifying lens mounted in said side configured for viewing, for magnifying an indirectly illuminated image of said card.

22. A viewing apparatus for enhancing a sports card comprising:

a body having a hollow central region, with one side of said body configured for viewing into said hollow central region, a first hollow side in said body adjacent said side configured for viewing, a discrete enclosure in said hollow side, said discrete enclosure having an opening communicating with said hollow central region, an illumination bulb mounted in said discrete enclosure, a power source coupled to said bulb for selective energization thereof, sports card receiving means for receiving at least one said sports card along an interior side of said hollow central region opposed from said side configured for viewing, and including an opening in said body through which said sports card may be conveniently inserted and removed to and from said hollow central region, so that said sports card is illuminated by light from said bulb and viewable through said side configured for viewing.

23. A viewing apparatus as set forth in claim 22 wherein interior surfaces of said hollow central region and said discrete enclosure are of a light scattering character.

24. A viewing apparatus as set forth in claim 22 further comprising a second hollow side adjacent said side configured for viewing, with said power source mounted in said second hollow side.

25. A viewing apparatus as set forth in claim 24 wherein said side configured for viewing is provided with a magnifying lens.

26. A viewing apparatus comprising:

a body having a hollow central region with interior surfaces of a light scattering character, one side of said body configured for magnifying and viewing contents of said hollow central region, a floor along a side of said hollow central region opposed from said side of said body configured for magnifying and viewing, said body further comprising a first hollow side and a second hollow side between said side configured for magnifying and viewing and said floor, a discrete enclosure having inner surfaces of a light scattering character in one of said first and second hollow sides, with an opening communicating between said hollow central region and said discrete enclosure, an electrical power source in another one of said first and second hollow sides, and coupled to said bulb for selective energization thereof, a first pair of opposed slots defining a first plane adjacent said floor, said opposed slots spaced to receive at least one printed card therebetween, whereby said card is indirectly illuminated by light from said bulb and an illuminated image thereof magnified for viewing.

27. A viewing apparatus comprising:

a body having a hollow central region with first and second hollow sides, a discrete enclosure in one of said first and second hollow sides, said enclosure having an opening communicating with said hollow central region, an illumination bulb mounted in said discrete enclosure, an electrical power source in another one of said first and second hollow sides, and coupled to said bulb for selective energization thereof, a first pair of opposed slots defining a first plane adjacent a third side of said body, said first pair of slots spaced to receive a narrow dimension of at least one printed card therebetween, a second pair of opposed slots defining a second plane adjacent said third side of said body, and spaced to receive a wider dimension of said card, a magnifying lens mounted in a fourth side of said body over said third side, for magnifying said card, whereby said card is indirectly illuminated by light from said bulb and an illuminated image thereof magnified by said lens.

28. A viewing apparatus as set forth in claim 31 wherein said first pair of slots and said second pair of slots are each of a width to accommodate a plurality of said cards.

* * * * *

UNITED STATES PATENT AND TRADEMARK OFFICE

CERTIFICATE OF CORRECTION

PATENT NO. : 5,570,275

DATED : Oct. 29, 1996

INVENTOR(S) : Leo H. Luquire

It is certified that error appears in the above-indentified patent and that said Letters Patent is hereby corrected as shown below:

At column 3, line 61, "coupled Go one terminal" should read "coupled to one terminal".

In column 10, claim 28 line 11, "as set forth in claim 31" should read "as set forth in claim 27".

Signed and Sealed this

Twenty-fifth Day of February, 1997

*Attest:*

Bruce Lehman

BRUCE LEHMAN

*Attesting Officer*

*Commissioner of Patents and Trademarks*